United States Patent [19]

Humble et al.

[11] 4,254,868

[45] Mar. 10, 1981

[54] ENCLOSURE FOR A SECURITY TAG AND EXTRACTION IMPLEMENT

[75] Inventors: David R. Humble, Plantation; Marlene J. Dietrich, Coral Springs, both of Fla.

[73] Assignee: Sensormatic Electronics Corporation, Deerfield Beach, Fla.

[21] Appl. No.: 9,256

[22] Filed: Feb. 5, 1979

[51] Int. Cl.[3] ..... B65D 73/02

[52] U.S. Cl. ..... 206/484; 206/460; 206/1.5

[58] Field of Search ..... 206/484, 233, 332, 460, 206/461, 471, 1.5; 40/340; 116/200; 229/71

[56] References Cited

U.S. PATENT DOCUMENTS

| | | | |
|---|---|---|---|
| 1,449,433 | 3/1923 | Munson | 40/340 |
| 3,370,365 | 2/1968 | Vosbikian | 206/484 |
| 3,446,421 | 5/1969 | Carrigan | 229/71 |
| 3,487,966 | 1/1976 | Kampf | 206/449 |
| 3,525,470 | 8/1970 | Carrigan | 229/71 |
| 3,924,746 | 12/1975 | Haines | 206/484 |
| 3,933,240 | 1/1976 | Humble | 206/1.5 |
| 3,942,640 | 3/1976 | Helstrom | 206/484 |

*Primary Examiner*—Herbert F. Ross

*Attorney, Agent, or Firm*—Watson, Leavenworth, Kelton & Taggart

[57] ABSTRACT

An enclosure of tough tear resistant plastic accepts a rectangular lamelliform electronic surveillance component through a slot in a paper panel and secures same by pressure sensitive adhesive to a flat surface of an article such as a phonograph record jacket. A razor edge implement manipulated by authorized personnel serves to sever a sidewall of a raised central portion of the enclosure and engage the component therein for convenient authorized extraction.

8 Claims, 17 Drawing Figures

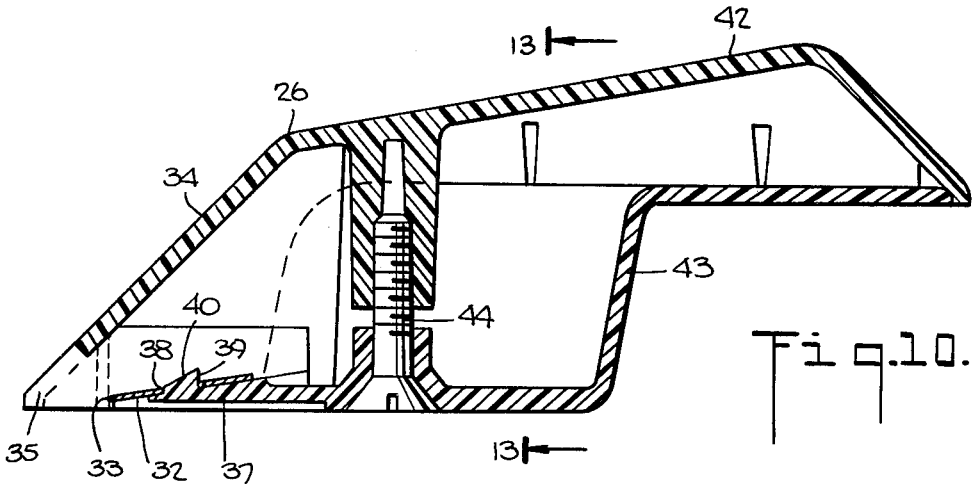
Fig. 10.
Fig. 11.
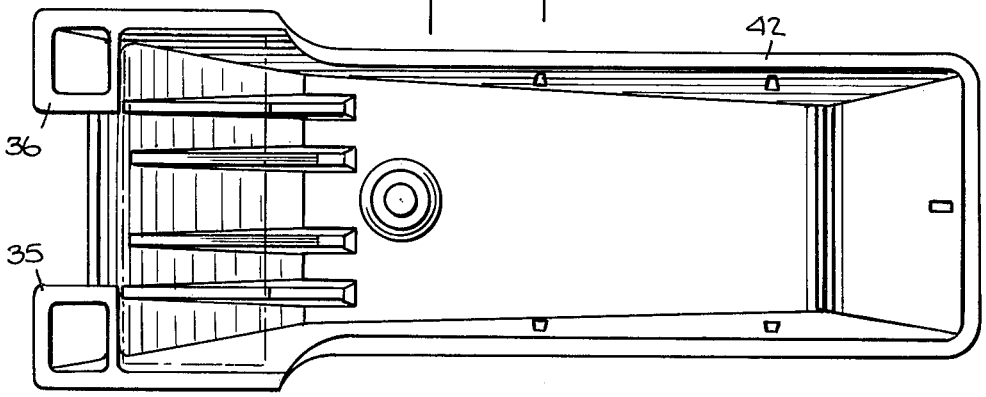
Fig. 12.
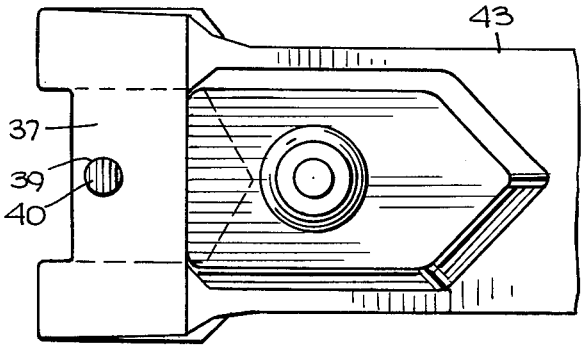
Fig. 13.
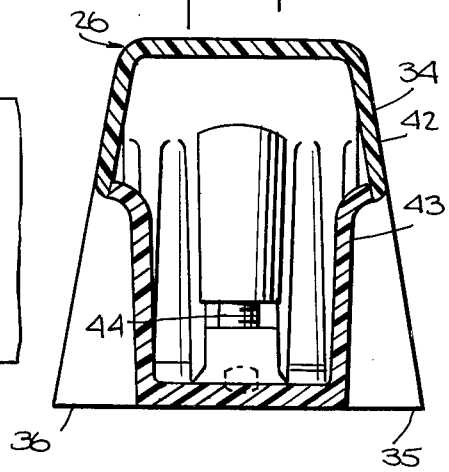

ENCLOSURE FOR A SECURITY TAG AND EXTRACTION IMPLEMENT

BACKGROUND OF THE INVENTION

The present invention relates to article surveillance and more particularly to an arrangement for temporarily securing to a flat surface of an article to be maintained under surveillance a lamelliform component which is detectable by a surveillance device.

In U.S. Pat. No. 4,063,229 of John Welsh et al. issued Dec. 13, 1977 for "Article Surveillance" there is described an electronic theft detection and surveillance system wherein sensor-emitter labels or tags containing a two-terminal nonlinear capacitor, e.g., a semiconductor diode, directly connected to antenna means are applied to articles for purpose of surveillance. As disclosed therein the tag may take various forms, one of which is a thin narrow rectangle. Several embodiments of transmitter and receiver are disclosed for cooperation with the tag.

A somewhat different detecting system for use with a thin rectangular tag containing a semi-conductor rectifier chip connected to dipole antenna elements is disclosed in U.S. Pat. No. 3,895,368 of Lloyd L. Gordon et al., issued July 15, 1975 for "Surveillance System and Method Utilizing Both Electrostatic and Electromagnetic Fields". Both of the above mentioned patents are assigned to the same assignee as the present invention and deal with the details of construction of the tag and the equipment for detecting its presence within a controlled space.

Depending upon the nature of the articles to be maintained under surveillance, there are different problems that must be surmounted in securing a sensor-emitter tag thereto. For theft protection of soft goods such as clothing or the like in retail stores, the tags may be affixed to the garments or other soft merchandise by an enclosure of the type disclosed in U.S. Pat. No. 3,942,829 of David Raymond Humble et al., issued Mar. 9, 1976 for "Reusable Security Tag", and assigned to the same assignee as the present invention. The detectable tag, rectangular and lamelliform, is sealed within a plastic enclosure which also contains a cruciate sheet metal clutch lock. A pin for piercing a garment is secured at the end of a lever arm which is hinged to said enclosure for controlled movement into said clutch lock. The pin is released from said clutch lock by application of a special tool to said enclosure for deforming the clutch lock to spread its jaws. The enclosure is made from a reasonably hard plastic and is intended to withstand substantial physical abuse.

In U.S. Pat. No. 3,933,240 of David R. Humble, issued Jan. 20, 1976 and assigned to the same assignee as the present invention, there is described apparatus for preventing the unauthorized removal of an article such as a tape cassette from a protected area comprising a container which has a main opening for receiving the article and at least two spaced key openings. The container is made of rigid plastic and carries an electromagnetic reradiator of the type mentioned previously and includes article retaining means having a first position clear of the main opening and a second position blocking the opening. An article release device at the point of sale includes at least two spaced keys which are simultaneously advanceable into the key openings for shifting the retaining means from the second position to the first position.

While the above patents describe various arrangements for securing a detectable component to certain articles of merchandise, there are certain articles for which no fully satisfactory method exists for afffixing the tags thereto. For example, while U.S. Pat. No. 3,933,240 describes apparatus for securing tags to recording cassettes, it does not furnish means for affixing such tags to the jackets and albums containing disc recordings or other flat surfaced objects that are too large to enclose within a separate security enclosure. Obviously such articles also are not amenable to affixing a tag thereto by means of the device described in the aforesaid U.S. Pat. No. 3,942,829.

Accordingly, it is a primary object of the present invention to provide a practical, convenient and efficacious arrangement for affixing a lamelliform security tag to flat surfaces such as the side of a record jacket or album or a carton or the like. Another object of the invention is to provide such an arrangement while rendering the security tag difficult to remove by a shoplifter but easily removable by an authorized individual.

SUMMARY OF THE INVENTION

In accordance with one aspect of the present invention, there is provided an enclosure for securing to a flat surface of an article which is to be maintained under surveillance against unauthorized transport through a surveillance zone a lamelliform component which is detectable by a surveillance device whenever said component enters said zone; said enclosure having a raised central portion bounded by a peripheral planar flange portion, and means applied to the underside of said flange portion for adhesively bonding said enclosure to said flat surface of an article; said central portion having in plan a contour corresponding to that of said component, a ceiling whose interior elevation as measured from the underside of said flange portion exceeds the thickness of said component by at least a few mils, and an exterior elevation sufficiently low as to resist grasping by human fingers; and said enclosure being formed from a tough tear resistant plastic material which is severable by a razor edge implement to permit authorized extraction of said component from said enclosure.

In accordance with a further aspect of the present invention there is provided a razor edge implement for extracting said component from an enclosure, said implement comprising a thin blade with a razor edge and a holder for said blade, said holder having means for guiding the application of said blade edge against said enclosure for severing said raised central portion from said flange portion adjacent the upper surface of the latter.

BRIEF DESCRIPTION OF THE DRAWINGS

The invention will be better understood after reading the following detailed description of the presently preferred embodiments thereof with reference to the appended drawings in which:

FIG. 10 is a longitudinal vertical sectional view of the implement of FIG. 1;

FIG. 11 is a bottom plan view of the upper portion of the implement shown in FIG. 10;

FIG. 12 is a top plan view of a part of the lower portion of the implement shown in FIG. 10;

FIG. 13 is a transverse sectional view taken along line 13—13 in FIG. 10;

Throughout the drawings, the same reference numerals are used to designate the same or similar parts.

DESCRIPTION OF THE PREFERRED EMBODIMENTS

Figures 1, 2:
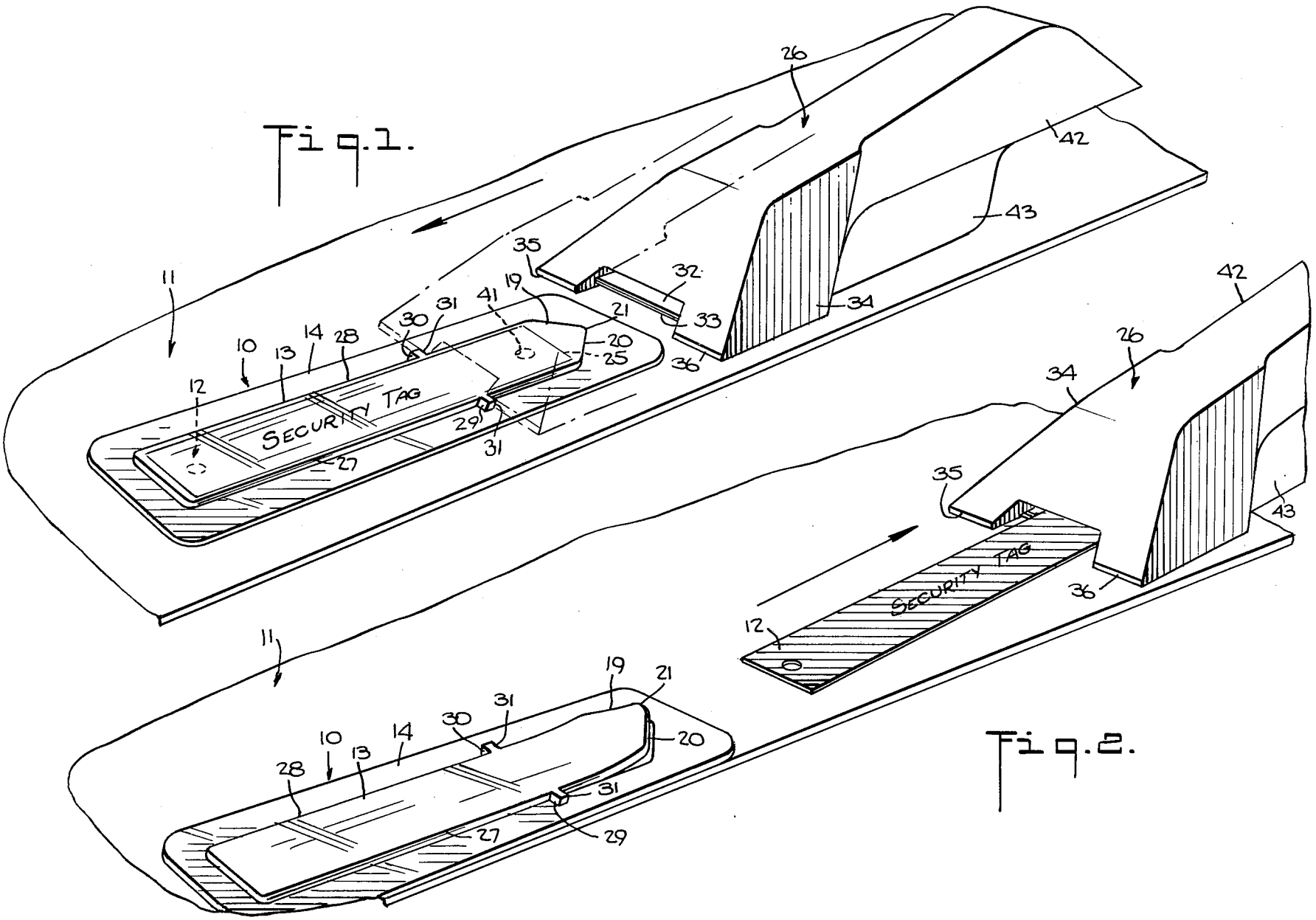
FIG. 1 is a perspective view showing a security tag affixed to a record jacket by an enclosure with an implement in position for removing same, all in accordance with the present invention.
FIG. 2 is a view similar to FIG. 1 showing the security tag being extracted by the implement.
Figure 3:
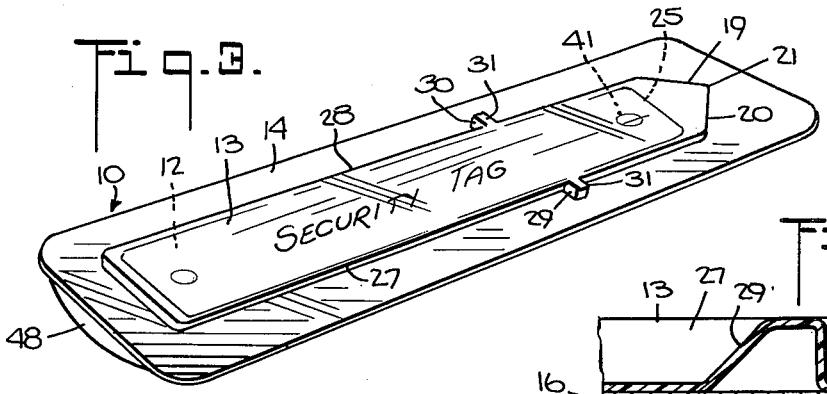
FIG. 3 is a perspective view of the enclosure containing a security tag as it appears prior to affixing to an article.

Referring now to FIG. 1 of the drawings, the enclosure, designated generally by the reference numeral 10, is shown for purpose of illustration affixed to a record jacket 11. It will be understood that in accordance with usual practice the jacket 11 will generally be formed from cardboard stock which is sealed within a transparent plastic wrapping such as shrink packaging film type "EHC Clysar", a poly olefin film manufactured by E. I. du Pont de Nemours & Co., Inc., Wilmington, Del., or the like. As shown in the drawings, the enclosure 10 may be transparent disclosing the lamelliform security tag 12 contained therein.

Figure 4:
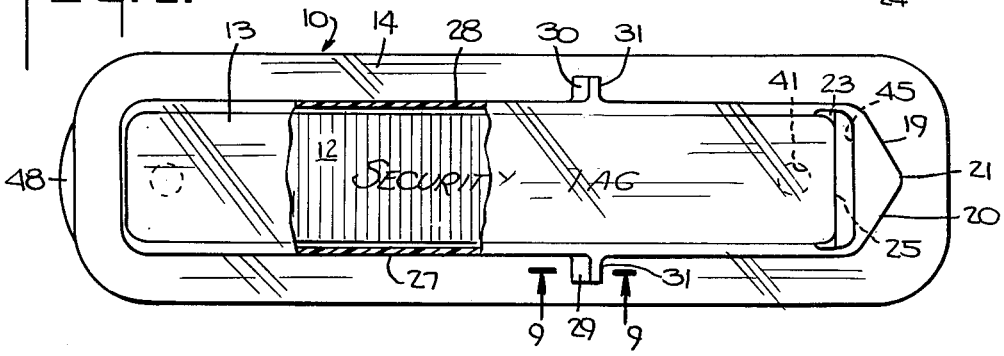
FIG. 4 is a top plan view with a portion broken away of the enclosure of FIG. 3.
Figure 5:
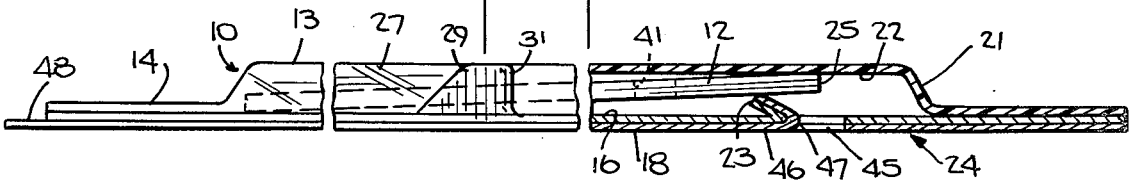
FIG. 5 is a side elevation view with a portion broken away of the enclosure of FIG. 3.
Figure 6:
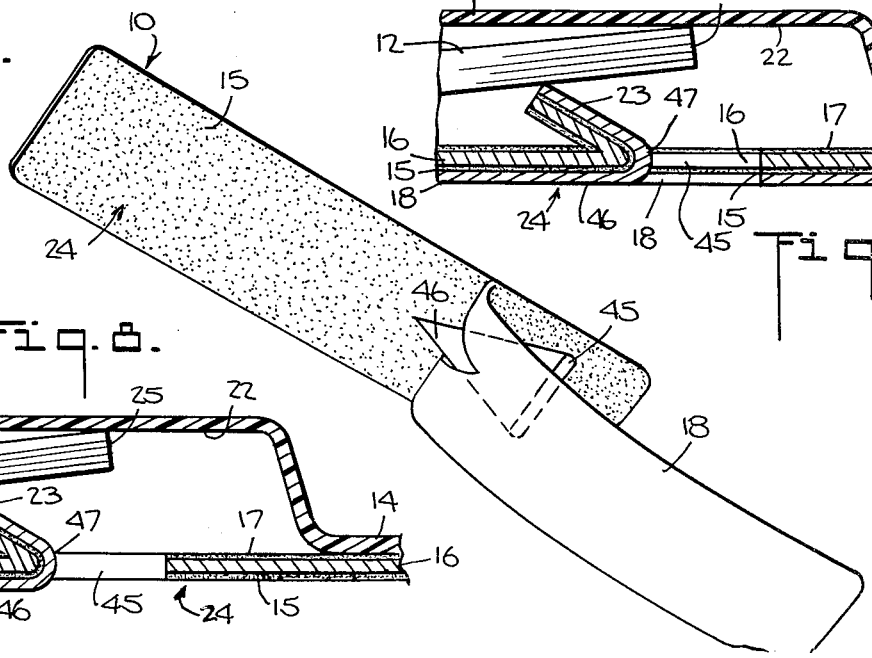
FIG. 6 is a view of the back of the enclosure showing the release paper being removed to expose the adhesive.
Figure 7:
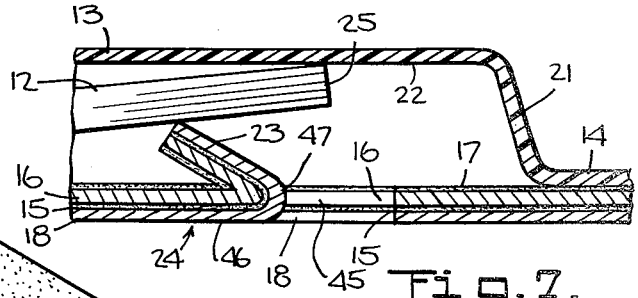
FIG. 7 is an enlarged fragmentary view of a portion of FIG. 5 showing certain additional details of construction.
Figure 8:
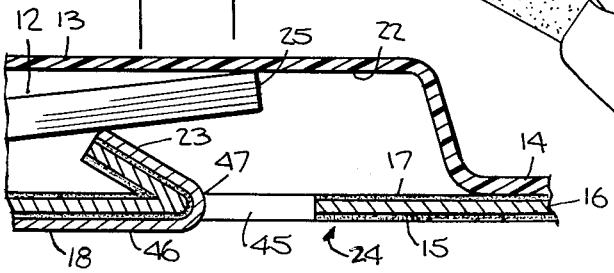
FIG. 8 is a view similar to FIG. 7, but after removal of the release paper.

As best seen in FIGS. 4, 5 and 7, the enclosure 10 has a raised central portion 13 bounded by a peripheral planar flange portion 14. A pressure sensitive adhesive 15 is applied to the underside of the flange portion 14 in the form of a coating on a paper layer 16 that has been fusion bonded through a heat sealing medium 17 to the material of the flange portion 14. The pressure sensitive adhesive 15 is protected by a layer 18 of release paper and serves, upon removal of the release paper, to bond adhesively the enclosure 10 to the flat surface of an article such as the record jacket or envelope 11. The central portion 13 of the enclosure 10 has a contour in plan which corresponds to that of the detectable component 12. In this example, the configuration is generally right rectangular with the exception of the taper provided by the angled walls 19 and 20 at one end converging at an intersection 21.

The central portion 13 has a ceiling 22 whose interior elevation as measured from the underside of the flange portion 14 exceeds the thickness of the component 12 by at least a few mils. The criteria for such elevation will be evident from the ensuing discussion. In any event, the exterior elevation of the central portion 13 should be sufficiently low as to resist grasping by human fingers.

It is desirable that the enclosure 10 be formed from a tear resistant plastic material which is severable by a razor edge implement to permit authorized extraction of the component 12 therefrom. It is presently preferred to vacuum form the central portion 13 and flange portion 14 from an integral sheet of a polyester resin. Suitable enclosures have been produced from "KODAR" Copolyester A 150 film of 7.5 mil thickness manufactured by Eastman Chemical Products, Inc., Plastics Division, Kingsport, Tenn. Similar film manufactured by Transilwrap Co. and sold under the "Meliform F." designation is also believed to be suitable. However, it is presently preferred to employ polyester sheet material produced by Allied Chemical Corporation and marketed under the designation "PETRA" Type A. It is also presently preferred to employ film having a nominal 5-mil thickness.

Figures 14, 15, 16, 17:
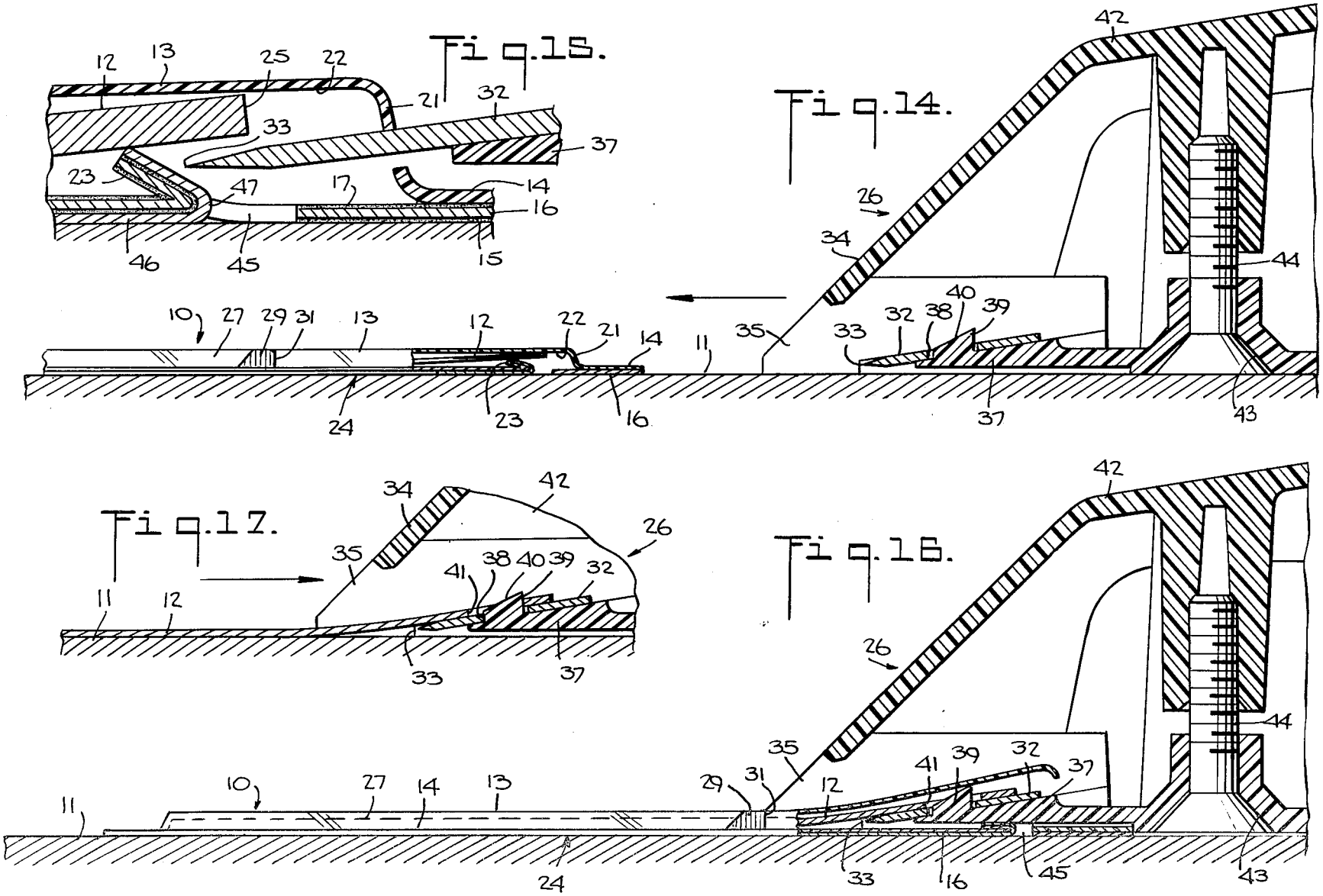
FIG. 14 is a longitudinal sectional view of the cooperating parts of the enclosure and implement shown in the same relationship as appears in solid lines in FIG. 1.
FIG. 15 is an enlarged fragmentary view showing the implement in the process of severing the wall of the enclosure.
FIG. 16 is a view similar to FIG. 14 but showing the implement advanced as far as it can go into the enclosure so as to engage the security tag for extraction.
FIG. 17 is a fragmentary view showing the implement extracting the tag.

As best seen in FIG. 7, an upstanding tab 23 is formed from the panel 24, consisting of the paper layer 16 and release paper 18 with adhesives sandwiched therebetween, which extends across the open area below the raised central portion 13 of the enclosure 10 secured to the undersurface of the flange portion 14. The tab 23 projects from the panel in the direction of the ceiling 22. The function of the tab 23 is to elevate one end 25 of the component 12 toward the ceiling 22 to provide clearance for a razor edge implement 26, see FIG. 15, to penetrate a sidewall, in this instance the walls 19 and 20, of the raised portion 13 and pass between the underside of the component 12 and the upper surface of the flange portion 14. Generally, the interior elevation of the ceiling 22 is selected when measured from the upper surface of the flange portion 14 to be at least substantially equal to the combined thickness of component 12 and the razor edge implement 26. Precise equivalence is not necessary since the plastic of the enclosure 10 will yield immediately upon severance of the sidewall by the knife edge such that the knife edge implement can force its way between the elevated tag 12 and the flange portion 14. The amount of clearance will depend upon the characteristics of the material from which enclosure 10 is formed.

Figure 9:
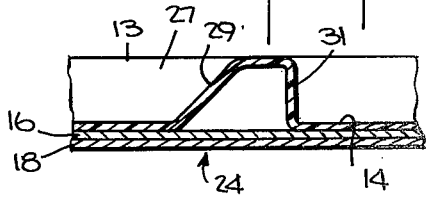
FIG. 9 is an enlarged sectional view taken along line 9—9 of FIG. 4 showing a stop for the removal implement.

For a purpose to be described hereinafter the longitudinal sidewalls 27 and 28 of the raised portion 13 have each formed therein a respective wing 29 and 30. As viewed from the side, with reference to FIG. 9, the wing has a vertical wall 31 which faces the end of the enclosure 10 containing the walls 19 and 20. The vertical wall 31 of the wing provides a stop for limiting the penetration of the release tool as will be understood after its description below.

The angled walls 19 and 20 due to their configuration serve as both a visible indicia of the point to which the razor edge implement is to be applied and a facilitated starting point for application of said implement thereto.

It is presently preferred that the interior elevation of the ceiling 22 as measured from the underside of the flange portion 14 lie within the range of about 30 mils to about 70 mils. The minimum elevation is determined by that which is required to accommodate a typical security tag 12 which may have a thickness slightly below 30 mils, while the maximum elevation is determined by that which can be accommodated conveniently on storage shelves containing record jackets and which is sufficiently low in profile as to afford difficulty when an attempt is made to grasp the same between human fingers.

Reference should now be had to FIGS. 1, 2, 14, 15, 16 and 17 wherein a razor edge implement designated generally by the numeral 26 is shown being applied to the enclosure 10 for severing same and removing the security tag 12 therefrom. The implement 26 comprises a thin blade 32 with a razor edge 33 and a holder 34 for said blade. The holder 34 has spaced apart feet 35 and 36 which can straddle the raised portion 13 of the enclosure 10 for guiding the application of the blade edge 33 against the intersection 21 of walls 19 and 20 for severing said walls and thereby separating the raised central portion 13 from the flange portion 14 adjacent the upper surface of the latter. The feet 35 and 36 ride on the upper surface of the flange portion 14 on opposite sides, respectively, of the raised portion 13. The holder 34 is provided with an inclined platform 37 supported between its feet 35 and 36 on which is disposed the blade 32. The blade 32 is provided with a central aperture 38 which registers with a post 39 projecting upwardly from the platform 37 behind the location of the edge 33 of blade 32. The upper end of the post 39 is tapered at 40 so that upon movement of the implement through the sidewall of the enclosure 10 the post 39 will slide under the raised out of component 12 until it registers with and enters an aperture 41 provided in the component 12. See FIG. 16.

The platform portion 37 of the holder resembles a plowlike element and functions to support the blade 32. The plowlike portion is disposed for penetrating the enclosure 10 edgewise behind the razor edge 33 of the blade 32 close to the upper surface of flange portion 14 so as to slip under the end of component 12 which is located within the enclosure 10 with its end 25 elevated towards ceiling 22. It should now be appreciated that the implement 26 can be advanced until its feet 35 and 36 encounter the wings 29 and 30 on the enclosure 10 as shown in phantom lines in FIG. 1.

The implement 26 may be formed in two parts, 42 and 43, secured together by a removable threaded fastener 44 while the blade 32 may be of standard construction formed from carbon steel such as those manufactured by American Safety Razor Company having a thickness of 15 mils. See FIGS. 10 to 13 for details of the implement 26.

Referring to FIG. 7, it will be seen that the panel 24 of the enclosure 10 is furnished with a slot 45 which results from displacing the tab 23 therefrom which slot accommodates insertion of the element 12 into the enclosure. In use, the retailer will be furnished with a supply of enclosures 10 which are intended to be expendable and a supply of security tags 12 intended for repeated use. When it is desired to affix the tag 12 to an article such as a record jacket, the tag 12 may be inserted through the slot 45 into an enclosure 10 whereupon the release paper 18 is peeled from the panel 24 exposing the pressure sensitive adhesive 15 thereon. When the release paper is removed a small vestige 46 of triangular configuration remains behind. The reason for permitting this small vestige of release paper to remain behind is to avoid destruction of the "hinge" along the edge 47 of the slot 45 which hinge supports the tab 23. The tab 23 is formed, in part, of the release paper, and if the tear-away-portions 46 were not provided, the portion of the release paper which forms part of the tab 23 would be drawn out and the tab destroyed upon removal of the release paper. In order to facilitate removal of the release paper, an edge of said paper is arranged to project at 48 beyond the flange portion 14 providing a convenient finger tab.

Having removed the release paper the clerk affixes the enclosure 10 with tag 12 therein to the record jacket or other flat surface of the article to be protected. It will be understood that the pressure sensitive adhesive should be strong enough to resist peeling from the normal materials to which the enclosure is intended to be affixed.

It should be understood from the foregoing that the enclosure 10 provides a low-cost means for attaching the security tag 12 to record jackets or the like. Its low profile, preferably less than 60 mils, provides shoplifting protection without significantly adding to the bulk of the merchandise and thereby reducing display space. While the enclosure 10 may be of transparent material is mentioned above, it may also be produced from an opaque or colored material if such is desired.

Having described the presently preferred embodiments of the subject invention, it will be understood by those skilled in the art that various changes in construction may be introduced without departing from the true spirit of the invention as defined in the appended claims.

What is claimed is:

1. An enclosure for securing to a flat surface of an article which is to be maintained under surveillance against unauthorized transport through a surveillance zone a lamelliform component which is detectable by a surveillance device whenever said component enters said zone; said enclosure having a raised central portion bounded by a peripheral planar flange portion, and means applied to the underside of said flange portion for adhesively bonding said enclosure to said flat surface of an article; said central portion having in plan a contour corresponding to that of said component, a ceiling whose interior elevation as measured from the underside of said flange portion exceeds the thickness of said component by at least a few mils, and an exterior elevation sufficiently low as to resist grasping by human fingers; said enclosure being formed from a tough tear resistant plastic material which is severable by a razor edge implement to permit authorized extraction of said component from said enclosure; and said enclosure including means constructed and arranged whenever said enclosure contains one of said components to elevate at least one end of said component toward said ceiling to provide clearance for said implement to penetrate a side wall of said raised portion and pass between the underside of said component and the upper surface of said flange portion.

2. An enclosure according to claim 1, wherein said interior elevation of said ceiling when measured from the upper surface of said flange portion is at least substantially equal to the combined thickness of said component and said razor edge implement.

3. An enclosure according to claim 1 or 2, wherein said means for elevating said component comprises an upstanding tab formed from a panel that is provided extending across at least a portion of the area below said central portion, said tab projecting from said panel in the direction of said ceiling, 4. An enclosure according to claim 3, wherein said panel spans the space between the margins of said flange portion joined to the undersurface of said flange portion and carrying on its outer surface a pressure sensitive adhesive for bonding said enclosure to said flat surface.

5. An enclosure according to claim 4, of generally rectangular configuration in plan, wherein said tab is located near one end of said raised portion, and said raised portion at said one end is tapered in plan to provide both a visible indicia and a facilitated starting point for authorized application of said implement thereto.

6. An enclosure according to claim 1, wherein said interior elevation of said ceiling as measured from the underside of said flange portion lies within the range of about 30 mils to about 70 mils.

7. An enclosure for securing to a flat surface of an article which is to be maintained under surveillance against unauthorized transport through a surveillance zone a lamelliform component which is detectable by a surveillance device whenever said component enters said zone; said enclosure having a raised central portion bounded by a peripheral planar flange portion, and means applied to the underside of said flange portion for adhesively bonding said enclosure to said flat surface of an article; said central portion having in plan a contour corresponding to that of said component, a ceiling whose interior elevation as measured from the underside of said flange portion exceeds the thickness of said component by at least a few mils, and an exterior elevation sufficiently low as to resist grasping by human fingers; said enclosure being formed from a tough tear resistant plastic material which is severable by a razor edge implement to permit authorized extraction of said component from said enclosure; said raised central portion being substantially rectangular in plan with substantially vertical and straight longitudinal side walls, and means on said enclosure for establishing a stop for limiting the attack of said razor edge implement to a portion of said enclosure which is sufficient to enable said extraction of said component.

8. An enclosure according to claim 7, wherein said stop means comprises transversely opposed projections from said side walls spaced from one end of said raised portion.

* * * * *